United States Patent [19]

Ogami et al.

[11] Patent Number: 5,077,168

[45] Date of Patent: Dec. 31, 1991

[54] TONER FOR ELECTROPHOTOGRAPHY AND PROCESS FOR PREPARATION THEREOF

[75] Inventors: Shunsuke Ogami, Hirakata; Atsushi Yamaguchi, Kobe; Hidenori Asada, Hirakata; Masanori Fujii, Sakai; Hiroshi Komata, Amagasaki; Kiminori Umeda, Sakai; Takahiko Kimura, Yokohama, all of Japan

[73] Assignee: Mita Industrial Co., Ltd., Osaka, Japan

[21] Appl. No.: 458,520

[22] Filed: Dec. 28, 1989

[30] Foreign Application Priority Data

Dec. 28, 1988 [JP] Japan ..... 63-329007

[51] Int. Cl.[5] ..... G03G 9/00; G03G 5/00

[52] U.S. Cl. ..... 430/109; 430/110; 430/111; 430/137

[58] Field of Search ..... 430/109, 137, 110, 111

[56] References Cited

U.S. PATENT DOCUMENTS 4,433,040 2/1984 Niimura et al. ..... 430/109
4,624,907 11/1986 Niimura et al. ..... 430/110
4,626,488 12/1986 Inoue ..... 430/109
4,824,751 4/1989 Matuura et al. ..... 430/109

FOREIGN PATENT DOCUMENTS 2115170 5/1987 Japan ..... 430/109

*Primary Examiner*—Marion E. McCamish
*Assistant Examiner*—Stephen C. Crossan
*Attorney, Agent, or Firm*—Sherman and Shalloway

[57] ABSTRACT

Disclosed is a toner for the electrophotography, which comprises as a main component a styrene/acrylic copolymer having at least two molecular weight distribution peaks, the molecular weight (Mw) of the peak on the lowest molecular weight side being lower than 13000, wherein the toner contains a charge controlling agent dispersed therein at a concentration of at least 0.3% by weight and the charge controlling agent has such a particle size distribution that the area ratio of particles having a particle size larger than 2.5 μm is at least 80% based on the section of the toner. If this toner is used, the fixing-possible temperature can be broadened while increasing the fixing ratio without reduction of the performances of the toner.

7 Claims, 1 Drawing Sheet

TONER FOR ELECTROPHOTOGRAPHY AND PROCESS FOR PREPARATION THEREOF

BACKGROUND OF THE INVENTION (1) Field of the Invention

The present invention relates to a toner for the electrophotography. More particularly, the present invention relates to a toner for the electrophotography having a broad fixing temperature range and having a high fixing ratio and an excellent copying resistance, and also to a process for the preparation of this toner.

(2) Description of the Related Art

In the dry electrophotographic process, fixation of a toner to a copying paper is generally accomplished by heat fixation, and this heat fixation is effected by supplying a copying paper having a toner image transferred from a photosensitive plate between a pair of rolls, at least one of which is heated. A toner formed by dispersing a colorant, a charge controlling agent, a release agent and other additives into a binder resin and adjusting the particle size to an appropriate level is used as the toner for the heat fixation.

In general, the fixing capacity of the toner depends mainly on the molecular weight distribution of the binder resin and the kind of the release agent such as a wax. Namely, if the molecular weight of the binder resin is low, the fixing temperature is generally low, and at a high temperature, there occurs high-temperature offset. On the other hand, if the molecular weight is high, the fixing temperature becomes high, and low-temperature offset or insufficient fixation tends to occur.

Accordingly, Japanese Examined Patent Publication No. 57-111543 proposes a process in which a binder resin having molecular weight distribution peaks at a molecular weight of 5000 to 80000 and a molecular weight of 100000 to 200000 is used to prevent high-temperature offset and low-temperature offset.

Since occurrence of the offset phenomenon can be prevented by improving the release property of the toner, various proposals have been made on selection of the kind and amount incorporated of the release agent such as a wax.

The above-mentioned prior art technique is excellent in that necessary and minimum fixation can be carried out at a specific fixing temperature without occurrence of any special trouble. However, in the case where it is desired to further improve the fixing ratio or it is intended to perform sufficient fixation even at a low temperature, it is necessary that the amount of the component having the molecular weight distribution on the low molecular weight side should be increased and the molecular weight on the low molecular weight side should be further lowered.

In the toner of the above-mentioned prior art technique, if the molecular weight of the peak on the low molecular weight side is lower than 15000, the fixing ratio is drastically improved, but high-temperature offset often occurs, the copying resistance (the number of obtainable copies) is degraded and contamination of the rolls becomes conspicuous. If the amount incorporated of a release agent such as a wax is increased for overcoming this disadvantage, blocking of the toner is caused, and the chargeability, transferability and fixing property are adversely influenced.

SUMMARY OF THE INVENTION

It is therefore a primary object of the present invention to provide a toner for the electrophotography, in which the above-mentioned defects can be overcome without reduction of performances of the toner and which has a wide fixing temperature range and a high fixing ratio without being influenced by the environment or the kind of a copying machine.

More specifically, in accordance with the present invention, there is provided a toner for the electrophotography, which comprises as a main component a styrene/acrylic copolymer having at least two molecular weight distribution peaks, the molecular weight (Mw) of the peak on the lowest molecular weight side being lower than 13000, wherein the toner contains a charge controlling agent dispersed therein at a concentration of at least 0.3% by weight and the charge controlling agent has such a particle size distribution that the area ratio of particles having a particle size larger than 2.5 μm is at least 80% based on the section of the toner.

Furthermore, in accordance with the present invention, there is provided a process for the preparation of a toner for the electrophotography, which comprises incorporating a metal-containing complex salt dye having such a particle size that the median diameter based on the volume is at least 5 μm, into a styrene/acrylic copolymer having at least two molecular weight distribution peaks, the molecular weight (Mw) of the peak on the lowest molecular weight side being lower than 13000, and dispersing the metal-containing complex salt dye in the copolymer in such a dispersion state that the area ratio of particles having a particle size larger than 2.5 μm is at least 80% based on the section of the toner.

DETAILED DESCRIPTION OF THE PREFERRED EMBODIMENTS

Figure 1:
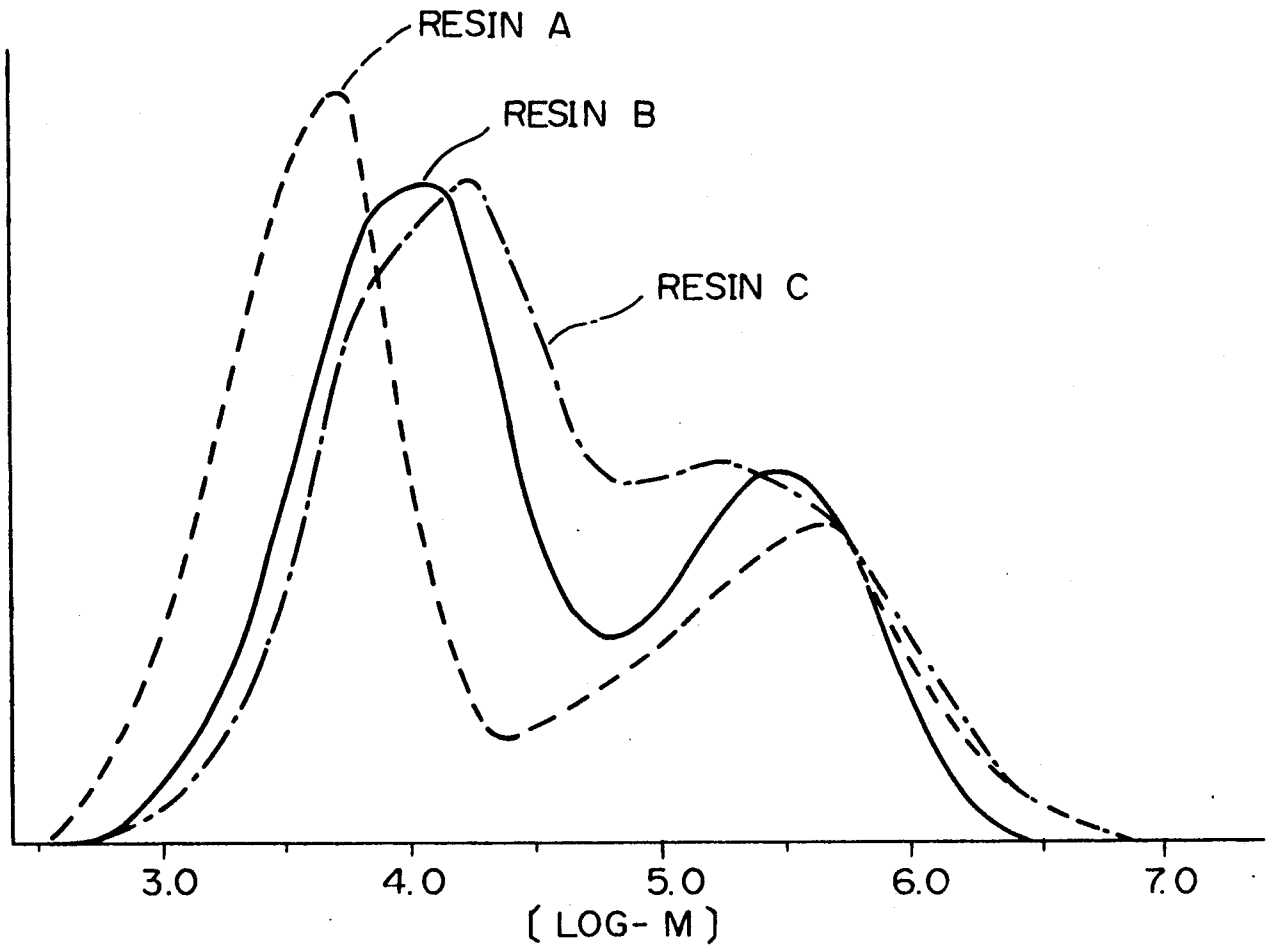
FIG. 1 is a graph showing the molecular weight distributions of various styrene/acrylic copolymers used in the examples.

In the toner of the present invention, it is a first condition that a styrene/acrylic copolymer having at least two molecular weight distribution peaks, the molecular weight (Mw) of the peak on the lowest molecular weight side being lower than 13000, should be used as the binder resin. By using a styrene/acrylic copolymer having the above-mentioned molecular weight distribution, the fixing-possible temperature range is broadened to the low temperature side and the fixing ratio is prominently improved, but the melt viscosity of the copolymer is lower than that of a styrene/acrylic copolymer having a molecular weight higher than 15000 at the peak on the low molecular weight side and the internal cohesive power is small when it is melted, and therefore, this copolymer is defective in that the toner readily adheres to the rollers.

The present invention is characterized in that in a toner comprising a styrene/acrylic copolymer having the above-mentioned molecular weight distribution, a charge controlling agent composed of a metal-containing complex salt dye is incorporated at a concentration of at least 0.3% by weight, especially 0.5 to 5% by weight, so that the charge controlling agent has such a particle size distribution that the area ratio of particles having a particle size larger than 2.5 μm is at least 80% based on the section of the toner. According to the present invention, by adjusting the concentration of the charge controlling agent to at least 0.3% by weight and producing such a particle size distribution that the area ratio of particles having a particle size larger than 2.5 μm is at least 80% based on the section of the toner, the offset-causing temperature on the high temperature side can be elevated without reduction of the fixing ratio at a low temperature.

If the content of the charge controlling agent is below the range specified in the present invention or the content based on the area of particles having a particle size larger than 2.5 μm is lower than 80%, the offset-causing temperature on the high temperature side is considerably lowered as compared with the offset-causing temperature in the present invention.

The fact that occurrence of high-temperature offset is greatly influenced by the content of the charge controlling agent in the toner or the dispersion particle size of the charge controlling agent has been found as a phenomenon as the result of many experiments made by us, and the theoretical ground has not been elucidated. However, it is presumed that the charge controlling agent dispersed in the form of particles having a relatively large dispersion particle size in the above-mentioned binder resin increases the internal cohesive power when the resin is melted, whereby adhesion of the resin to the rollers is prevented and occurrence of high-temperature offset or contamination of the rollers is prevented.

In the present invention, in order to produce such a particle size distribution of the charge controlling agent that the proportion of particles having a particle size larger than 2.5 μm in the toner is at least 80%, it is preferred that the charge controlling agent, especially the metal-containing complex salt dye, having a median diameter based on the volume of at least 5 μm be used and be incorporated and dispersed in the styrene/acrylic copolymer.

Styrene/Acrylic Copolymer

The styrene/acrylic copolymer used in the present invention has at least two molecular weight distribution peaks, and the molecular weight (Mw) of the peak on the lowest molecular weight side is lower than 13000. A typical instance of the molecular weight distribution curve of the styrene/acrylic copolymer having a plurality of molecular weight distribution peaks is shown in FIG. 1 of the accompanying drawing. The molecular weight of the peak on the high molecular weight side in the molecular weight distribution is not particularly critical, but it is preferred that the molecular weight (Mw) of the peak on the high molecular weight side be 300000 to 700000, especially 350000 to 550000. It also is preferred that the dispersion expressed by Mw/Mn be at least 15, especially 16 to 70.

The ratio between styrene and the acrylic monomer in the copolymer can be changed in a broad range, but it is preferred that the styrene/acrylic monomer molar ratio be from 60/40 to 98/2, especially from 70/30 to 90/10. As the acrylic monomer, there can be mentioned alkyl esters of (meth)acrylic acid such as methyl (meth-)acrylate, ethyl (meth)acrylate, propyl (meth)acrylate, butyl (meth)acrylate and 2-ethylhexyl (meth)acrylate, acrylic acid and methacrylic acid, (meth)acrylonitrile, (meth)acrylamide, (meth)acrylhydroxyalkyl esters such as (meth)acryl-2-hydroxyethyl and (meth)acryl-3-hydroxypropyl, (meth)acrylaminoalkyl esters such as (meth)acryl-2-aminoethyl, (meth)acryl-3-aminopropyl and N-ethyl(meth)acryl-2-aminoethyl, and glycidyl (meth)acrylate. Preferably, the acrylic monomer is composed mainly of an alkyl ester of (meth)acrylic acid.

Charge Controlling Agent

The charge controlling agent used in the present invention has a median diameter $D_{50}$) based on the volume of at least 5 μm, especially 10 to 20 μm, when incorporated in the toner, and when the charge controlling agent is dispersed in the toner, particles having a particle size larger than 2.5 μm occupies at least 80% of the entire particles.

A metal-containing complex salt dye, especially a 2:1 type metal-containing complex salt dye (dye molecule/metal=2/1), is preferably used as the charge controlling agent. This metal-containing complex salt dye can be represented by the following formula:

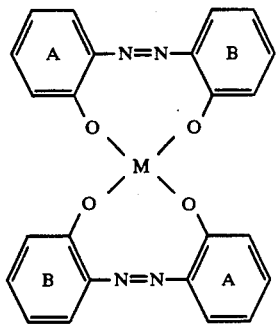

wherein rings A and B can possess a fused ring or can have a substituent such as a halogen atom, a nitro group, an alkyl group or an amide group, and M represents a transition metal.

As the transition metal M, there can be mentioned Cr, Co, Fe, Ni and Cu. A complex salt dye containing Cr is preferably used.

The metal complex salt dye used as the charge controlling agent in the present invention can be obtained, for example, by a method in which a dye synthesized by known means is pulverized and classified, or a method in which the above-mentioned dye is recrystallized from an organic solvent.

Preparation of Toner

In the production of the toner of the present invention, the indispensable component of the charge controlling agent is added to the styrene/acrylic copolymer resin and known additives are optionally added to the mixture.

At least one member selected from the group consisting of coloring pigments, extender pigments, magnetic pigments and electroconductive pigments can be used as the pigment. Of course, a pigment having at least two of the above-mentioned functions can be used. For example, carbon black acts not only as a black pigment but also as an electroconductive pigment, and triiron tetroxide acts not only as a magnetic pigment but also as a black pigment, as is seen from the name "iron black".

Examples of appropriate coloring pigments are described below.

Black Pigments

Carbon black, acetylene black, lamp black and aniline black.

Yellow Pigments

Chrome yellow, zinc yellow, cadmium yellow, yellow iron oxide, Mineral Fast Yellow, nickel-titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange Pigments

Chrome orange, molybdenum orange, Permanent Orange GTR, Pyrazolone Orange, Vulcan Orange, Indanthrene Brilliant Orange RK, Benzidine Orange G and Indanthrene Brilliant Orange GK.

Red Pigments

Red iron oxide, cadmium red, red lead, cadmium mercury sulfide, Permanent Red 4R, Lithol Red, Pyrazolone Red, Watchung Red calcium salt, Lake Red D, Brilliant Carmine 6B, Eosine Lake, Rhodamine Lake B, Alizaline Lake and Brilliant Carmine 3B.

Violet Pigments

Manganese violet, Fast Violet B and Methyl Violet Lake.

Blue Pigments

Iron blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments

Chrome green, chromium oxide, Pigment Green B, Marachite Green Lake and Fanal Yellow Green G.

White Pigments

Zinc flower, titanium oxide, antimony white and zinc sulfide.

Extender Pigments

Baryte powder, barium carbonate, clay, silica, white carbon, talc and alumina white.

As the magnetic material pigment, there have been used, for example, triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$) , neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic materials can optionally be used in the present invention. Triiron tetroxide is especially preferably used for attaining the object of the present invention.

As the electroconductive pigment, there can optionally be used non-electroconductive inorganic fine powders which have been subjected to an electroconductive treatment, and various metal powders, as well as the above-mentioned carbon black.

The amount incorporated of the pigment can be changed over a broad range according to the intended use of the toner, but in general, the pigment is used in an amount of 1 to 300% by weight based on the fixing agent. In the case where the toner is used in combination with a magnetic toner for a two-component developer, it is preferred that the coloring pigment be used in an amount of 1 to 15% by weight, especially 2 to 10% by weight, based on the fixing agent. When the toner is used as the one-component type magnetic toner, it is preferred that the magnetic material pigment be used in an amount of 50 to 300% by weight, especially 60 to 250% by weight, based on the fixing agent, if necessary together with a coloring pigment or an electroconductive pigment.

Other known additives can be incorporated into the toner of the present invention according to known recipes. For example, a silicone oil, a low-molecular-weight olefin resin and a wax can be used for assisting the release property.

The above-mentioned copolymer composition is kneaded with the pigment, and the kneaded composition is cooled, pulverized and, if necessary, classified, whereby the toner of the present invention is obtained. Of course, mechanical high-speed stirring can be carried out for rounding indeterminate particles.

The particle size of the toner particles depends on the resolving power, but it is generally preferred that the particle size be 5 to 35 microns.

In the electrostatic photographic copying process using the toner of the present invention, formation of an electrostatic latent image can be performed according to any of the known methods. For example, an electrostatic latent image can be formed by uniformly charging a photoconductive layer on an electroconductive substrate and subjecting the photoconductive layer to imagewise light exposure.

In case of the one-component type magnetic toner, the electrostatic image is developed by contacting the substrate with the magnetic brush of the toner, and in case of the two-component type developer, the toner is mixed with a magnetic carrier and the static image is developed by contacting the substrate with the magnetic brush. The toner image formed by the development is transferred onto a copying paper and the toner image is fixed by contact with a hot roll.

According to the present invention, as is apparent from the foregoing description, by dispersing a charge controlling agent with a specific dispersed particle size distribution into a styrene/acrylic copolymer having a specific molecular weight distribution, the fixing-possible temperature range can be broadened while increasing the fixing ratio without degradation of various characteristics of the toner.

Examples

The present invention will now be described in detail with reference to the following examples.

Styrene/acrylic copolymers and charge controlling agents shown in Tables 1 and 2 were used:

Into 100 parts by weight of the resin were incorporated and dispersed 8 parts by weight of carbon black, 0.5 part by weight of low-molecular-weight polypropylene and the charge controlling agent in an amount shown below, and the mixture was melt-kneaded and cooled. The cooled product was then pulverized and classified. Thus, toners 1 through 9 described below were prepared.

Toner 1

Resin A was used and 1 part by weight of dye a was used a the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 83% based on the area.

The kneaded and cooled product was pulverized and classified to obtain a toner having an average particle size of 16 μm.

Toner 2

Resin B was used and 1 part by weight of dye a was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 85% based on the area.

The kneaded and cooled product was pulverized and classified to obtain a toner having an average particle size of 17 μm.

Toner 3

Resin C was used and 1.5 parts by weight of dye a was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 82% based on the area. The particle size of the toner was 15 μm.

Toner 4

Resin A was used and 1 part by weight of dye b was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 30% based on the area. The particle size of the toner was 16 μm.

Toner 5

Resin B was used and 1 part by weight of dye b was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 42% based on the area. The particle size of the toner was 17 μm.

Toner 6

Resin C was used and 1 part by weight of dye b was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 50% based on the area. The particle size of the toner was 16 μm.

Toner 7

Resin A was used and 1 part by weight of dye c was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 34% based on the area. The particle size of the toner was 15 μm.

Toner 8

Resin A was used and 0.3 part by weight of dye a was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 75% based on the area. The particle size of the toner was 16 μm.

Toner 9

Resin B was used and 1.5 parts by weight of dye a was used as the charge controlling agent. After the melt kneading and cooling, the obtained kneaded and cooled product was set at a microtome and cut into a thickness of 1.0 μm by a glass knife. The dispersion state of the charge controlling agent in the section was examined. As the result, it was found that agglomerated particles having a particle size larger than 2.5 μm occupied 74% based on the area. The particle size of the toner was 17 μm.

Each of the foregoing toners was mixed with a ferrite carrier having an average particle size of 90 μm to obtain a developer having a toner concentration of 3 to 5%.

The developer was subjected to the image-forming test by using a high-speed copying machine (A4 copying papers were laterally fed at a rate of 55 papers per minutes)(Model DC-5585 supplied by Mita Industrial Co. Ltd.) and a low-speed copying machine (A4 copying papers were laterally fed at a rate of 20 papers per minutes)(Model DC-2055 supplied by Mita Industrial Co. Ltd.), each being provided with a fixing device of the heating and pressing type, and the high-temperature offset-causing temperature and the fixing strength-depending temperature (the temperature at which the fixing ratio of at least 90% was attained) were measured. Furthermore, the copying resistance test for forming 50000 prints was carried out and the image characteristics were examined.

The high-temperature offset-causing temperature was determined in the following manner. The temperature of the heating roll of each copying machine was elevated from 100° C. stepwise by 2.5° C., and it was checked whether or not the portion of the heating roller which had fixed the image on the top end portion of the transfer paper having the toner image transferred thereto caused the toner contamination in the non-image area of the transfer paper with rotation of the roller. The temperature at which the contamination was caused was designated as the offset-causing temperature.

The fixing strength-depending temperature was determined in the following manner.

The temperature of the heating roller was elevated from 90° C. stepwise by 2.5° C., and an adhesive tape was press-bonded to the fixed image formed by fixing the toner image transferred to the copying sheet. Then, the adhesive tape was peeled. The image density of the fixed image was measured before and after the peeling by using a reflection densitometer. The temperature at which the fixing ratio, expressed by the following formula, was at least 90% was determined:

$$\text{Fixing ratio (\%)} = \frac{\text{image density after peeling}}{\text{image density before peeling}}$$

-continued

Dyes (b)

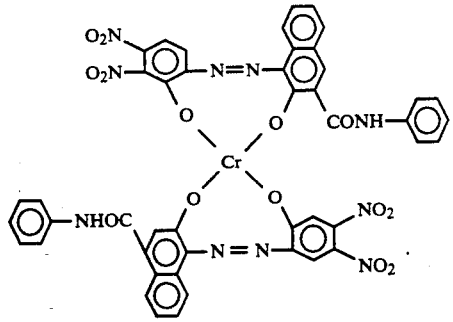

TABLE 3

| Toner No. | Resin | Dye | Concentration (% by weight) of Charge Controlling Agent | Area Ratio (%) of Particles Having Particle Size Larger than 2.5 μm | High-Temperature Offset-Causing Temperature (°C.) 55 papers/min machine | High-Temperature Offset-Causing Temperature (°C.) 20 papers/min machine | Fixing Strength-Depending Temperature (°C.) 55 papers/min machine | Fixing Strength-Depending Temperature (°C.) 20 papers/min machine |
|---|---|---|---|---|---|---|---|---|
| 1 | A | a | 0.9 | 83 | 205 | 180 | 150 | 120 |
| 2 | B | a | 1.4 | 85 | 210 | 185 | 155 | 125 |
| 3 | C | a | 0.9 | 82 | 200 | 170 | 165 | 140 |
| 4 | A | b | 0.9 | 30 | 185 | 165 | 150 | 125 |
| 5 | B | b | 0.9 | 42 | 190 | 170 | 150 | 125 |
| 6 | C | b | 0.9 | 50 | 185 | 165 | 165 | 135 |
| 7 | A | c | 0.9 | 34 | 185 | 165 | 155 | 125 |
| 8 | A | a | 0.2 | 75 | 185 | 170 | 150 | 120 |
| 9 | B | a | 1.4 | 74 | 190 | 170 | 155 | 120 |

TABLE 1

| | Resin A | Resin B | Resin C |
|---|---|---|---|
| Weight Average Molecular Weight (Mw) | $2.7 \times 10^5$ | $1.4 \times 10^5$ | $2.1 \times 10^5$ |
| Mw/Mn | 64.9 | 16.4 | 18.7 |
| Molecular Weight at Low Molecular Weight Peak | 3834 | 12700 | 14156 |
| Molecular Weight at High Molecular Weight Peak | 530111 | 365301 | 384265 |

TABLE 2

| Median Particle Size Based on Volume | Dye a 1:2 type chrolium-containing monoazo complex salt dye | Dye b 1:2 type chrolium-containing monoazo complex salt dye | Dye c zinc salycilate complex salt dye |
|---|---|---|---|
| $D_{50}$ (μm) | 13.6 | 3.3 | 18.4 |
| $D_{25}$ (μm) | 20.5 | 4.4 | 30.3 |
| $D_{75}$ (μm) | 8.5 | 2.5 | 12.7 |

Dyes (a)

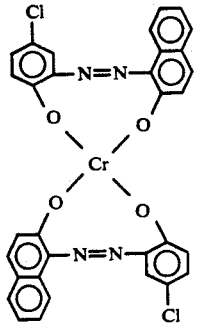

We claim:

1. A toner for the electrophotography, which comprises as a main component a styrene/acrylic copolymer having at least two molecular weight distribution peaks, the molecular weight (Mw) of the peak on the lowest molecular weight side being lower than 13000, wherein the toner contains a charge controlling agent which is a metal-containing complex salt dye dispersed therein at a concentration of at least 0.3% by weight and the charge controlling agent has such a particle size distribution that the area ratio of particles having a particle size larger than 2.5 μm is at least 80% based on the section of the toner.

2. A toner as set forth in claim 1, wherein the metal-containing complex salt dye is a 1:2 type chromium complex salt dye.

3. A toner as set forth in claim 1, wherein the charge controlling agent is contained in an amount of 0.5 to 5% by weight.

4. A toner as set forth in claim 1, wherein the styrene/acrylic copolymer has a molecular weight (Mw) of 300000 to 700000 at the peak on the high molecular weight side of the molecular weight distribution.

5. A toner as set forth in claim 1, wherein the styrene/acrylic copolymer has a dispersion (Mw/Mn) of 16 to 17.

6. A toner as set forth in claim 1, wherein the styrene/acrylic copolymer comprises styrene and an acrylic monomer at a molar ratio of from 60/40 to 98/2.

7. A toner as set forth in claim 1, which has a particle size of 5 to 35 microns.

* * * * *